US008109846B2

(12) United States Patent
Schmidt

(10) Patent No.: US 8,109,846 B2
(45) Date of Patent: Feb. 7, 2012

(54) LACROSSE HEAD HAVING MARKED MEASUREMENT POINTS

(75) Inventor: Joshua G. Schmidt, Royal Oak, MI (US)

(73) Assignee: Warrior Sports, Inc., Warren, MI (US)

( * ) Notice: Subject to any disclaimer, the term of this patent is extended or adjusted under 35 U.S.C. 154(b) by 240 days.

(21) Appl. No.: 12/393,563

(22) Filed: Feb. 26, 2009

(65) Prior Publication Data

US 2009/0247331 A1 Oct. 1, 2009

Related U.S. Application Data

(60) Provisional application No. 61/040,787, filed on Mar. 31, 2008.

(51) Int. Cl.
*A63B 59/02* (2006.01)
*A63B 65/12* (2006.01)

(52) U.S. Cl. ..... 473/513; D21/724

(58) Field of Classification Search ..... 473/513, 473/512, 505; D21/724
See application file for complete search history.

(56) References Cited

U.S. PATENT DOCUMENTS 292,168 A * 1/1884 Lytle ..... 7/138
2,501,757 A * 3/1950 Cagle ..... 7/145
2,600,773 A * 6/1952 Hungerford ..... 43/12
3,119,424 A * 1/1964 Henry ..... 81/20
4,358,117 A * 11/1982 Deutsch ..... 473/513
4,732,058 A * 3/1988 Chung ..... 81/20
5,685,791 A * 11/1997 Feeney ..... 473/513
5,820,438 A * 10/1998 Horton, III ..... 446/213
5,826,466 A * 10/1998 Weissbach ..... 81/26
6,926,627 B1 * 8/2005 LeMire et al. ..... 473/513
7,407,456 B2 * 8/2008 Price et al. ..... 473/513

OTHER PUBLICATIONS webpage download, e-lacrosse, 1999,http://www.e-lacrosse.com/1999/dyewinner/1.html, 3 pages.*
Webpage download, NCAA Lacrosse Rules,2010,www.ncaapublications.com/productdownloads/LC10.pdf, 1 page.*
Revo Pro Head (2006).
Dealer Information Letter (2006).

* cited by examiner

*Primary Examiner* — Gene Kim
*Assistant Examiner* — M Chambers
(74) *Attorney, Agent, or Firm* — Warner Norcross & Judd LLP

(57) ABSTRACT

A lacrosse head includes a ball stop (throat), a pair of opposing sidewalls, and a scoop. The sidewalls can include visible markings, or sets of indicia, on the front and/or on the rear of the head. The indicia can be located at 1.25, 3.0, and 5.0 inches from the ball stop. The indicia can be marked on the surface of the sidewalls, and/or can be in the form or protrusions on or recesses defined by the sidewalls. The indicia can provide consistent measurement locations to assist officials and others in measuring the lacrosse head to ensure that it complies with the proposed 2010 NCAA Men's Lacrosse Rules regarding the dimensional measurements for a lacrosse head. A method for molding the lacrosse head including the indicia is also provided.

18 Claims, 3 Drawing Sheets

LACROSSE HEAD HAVING MARKED MEASUREMENT POINTS

CROSS-REFERENCE TO RELATED APPLICATIONS

The present invention claims benefit of U.S. Provisional Application No. 61/040,787, filed Mar. 31, 2008, and entitled "Lacrosse Head Having Marked Measurement Points," which is hereby incorporated by reference.

BACKGROUND OF THE INVENTION

The present invention generally relates to a lacrosse head for attachment to a lacrosse handle, and more particularly to a lacrosse head including regions marked with measurement indicia.

Conventional lacrosse heads are constructed of an open frame having a ball stop joined with a base, a pair of sidewalls that diverge from the ball stop, and a scoop that connects the sidewalls, opposite the ball stop. The frame has string holes to secure a lacrosse net around the back side of the frame, leaving the opposing side of the frame open for catching or shooting a lacrosse ball. The lacrosse frame is attached to a handle by a throat that projects rearwardly from the base, with a socket formed in the base for attachment to a handle.

To maximize ball retention in the lacrosse head, many head designs incorporate sidewalls that are generally narrowly spaced from one another. Some head sidewalls are specifically flared or otherwise configured to further maximize ball retention and shot accuracy.

In 2007, the National Collegiate Athletic Association ("NCAA") Men's Lacrosse Committee sought ways to address alleged safety concerns in the sport of lacrosse via the design of lacrosse heads. Many committee members believed that the dimensions of conventional lacrosse head designs did not allow the lacrosse ball to come out of head easily enough. As a result, players allegedly slashed and cross-checked other players' lacrosse sticks harder in an effort to dislodge the ball and create turnovers.

In response to these concerns, the NCAA Men's Lacrosse Committee proposed rule changes that would require the lacrosse heads to dimensioned to allow the lacrosse ball to come out of the head more easily, thereby reducing both the frequency and force of contact in the game. These rule changes are tentatively scheduled to go into effect in 2010 and will be enforced in all NCAA Men's lacrosse competition.

One of the proposed 2010 NCAA Men's Lacrosse Rules (referred to as the "Proposed Rules" herein), and in particular, Rule 1.17, addresses the minimum dimensional measurements between various portions of the sidewalls measured at a specific distance from the throat of the lacrosse head. Specifically, at distances of 1.25 and 3 inches, respectively, from the throat, and particularly the inner surface of the ball stop, the minimum distance between the sidewalls is 3 inches when measured between the front of opposing sidewalls (i.e., at the ball receiving side) and 3 inches when measured between the rear surfaces of the sidewalls (i.e., at the ball retaining side). At a distance of 5.0 inches from the throat, the minimum distance is 4.0 inches when measured between the front surfaces of the sidewalls (i.e., at the ball receiving side) and 3.5 inches when measured between the rear surfaces of the sidewalls (i.e., at the ball retaining side). Finally, the minimum distance at the widest point between the sidewalls is 6.5 inches on the front surfaces of the sidewalls, and 6.0 inches on the rear surfaces of the sidewalls.

The NCAA Men's Lacrosse Committee believes that the Proposed Rules will decrease ball retention during play. The Proposed Rules will also prohibit the use of currently legal head designs in NCAA competition. Although the Proposed Rules will help protect players against injury, players will continue to seek lacrosse heads which maximize ball retention while conforming to the new proposed NCAA rules. Therefore, lacrosse head designers face the challenge of constructing a head that conforms to the proposed 2010 NCAA dimensional measurements while still maximizing the ball retention for the player.

Under the Proposed Rules, game officials will determine the precise locations on a lacrosse head to take the prescribed measurements and evaluate compliance with the Proposed Rules via those measurements. To do so, an official will simultaneously measure the distance from the throat to establish the locations of measurement, as well as the distance between the sidewalls at those locations of measurement. The official will likely be challenged in taking these measurements, as they are at right angles to one another—in turn, this may lead to uncertainty in determining whether a lacrosse head complies with the Proposed Rules.

SUMMARY OF THE INVENTION

The present invention provides a lacrosse head that is easily measured for dimensional compliance with the 2010 NCAA Men's Lacrosse Rules regarding the minimum dimensional measurements between the sidewalls measured at specific distances from the throat of the lacrosse head. The lacrosse head includes an open frame having a throat (e.g. a ball stop), a pair of opposing sidewalls, and a scoop.

In one embodiment, the lacrosse head includes indicia, which is visible to the human eye, located on the sidewalls to facilitate measuring dimensional compliance with the Proposed Rules. The indicia can be located along the front, or ball receiving side, of the head, and/or along the rear, or ball retaining side, of the head. The indicia can be located at 1.25, 3.0, and 5.0 inches from the throat of the lacrosse head. Additional indicia can be provided along the front and rear of the head, where that additional indicia corresponds to the widest point on the front and/or rear of the head.

In another embodiment, the indicia can be of a variety of forms. For example, the indicia can be visible lines located along a visible surface of the sidewalls. These visible lines can be in the form of linear or other geometrically configured projections or depressions in the surfaces of the sidewalls. The visible lines can be configured in pairs, with individual lines from the pairs positioned on opposite sidewalls. The individual lines can lie in a single plane that is perpendicular to a plane running the length of the head from the scoop to the throat, bisecting the lacrosse head into mirror images.

In yet another embodiment, the indicia can be or include alphanumeric characters or symbols. As an example, "1.25 inches" can be placed on the front of a sidewall at a distance 1.25 inches from the throat. Optionally, the indicia can include both the line and alphanumeric marking. For example, immediately adjacent the text "1.25 inches", a linear depression or projection can be included in the sidewall, with that structure being located exactly 1.25 inches from the throat when appropriately measured. In this way, the lacrosse head can be measured between a pair of indicia to determine compliance with the new dimensional measurements at prescribed locations on the head.

These and other objects, advantages, and features of the invention will be more fully understood and appreciated by reference to the description of the current embodiment and the drawings.

DETAILED DESCRIPTION OF THE CURRENT EMBODIMENT

Figure 1:
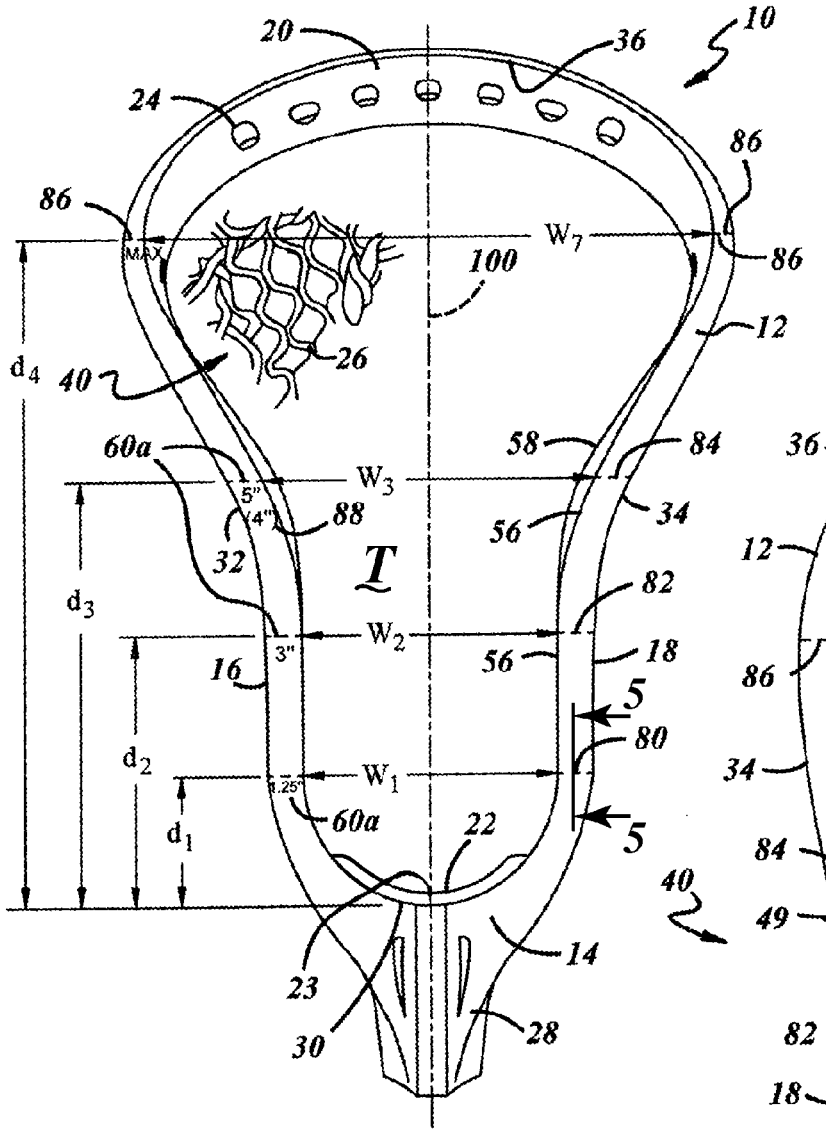
FIG. 1 is a front view of a lacrosse head in accordance with a current embodiment of the present invention.

A current embodiment of the lacrosse head of the present invention is shown in FIGS. 1-4 and generally designated 10. The lacrosse head 10 includes a frame 12 having a base 14, a pair of opposing sidewalls 16, 18, and a scoop 20 connecting the pair of opposing sidewalls 16, 18 opposite the base 14. The frame can include a ball stop 23, to which a ball stop cushion 22 may be adhered or otherwise secured. As used herein, the term "ball stop" corresponds to the term "throat of crosse" as illustrated in Appendix IV of, and used in, the Proposed Rules, which are hereby incorporated by reference. For example, when a distance or measurement is said to be a certain number of inches or units from the ball stop, it is meant that the distance or measurement is measured fro the throat of the crosse as provided under the Proposed Rules. Each of the above structures will now be described in further detail.

Figure 2:
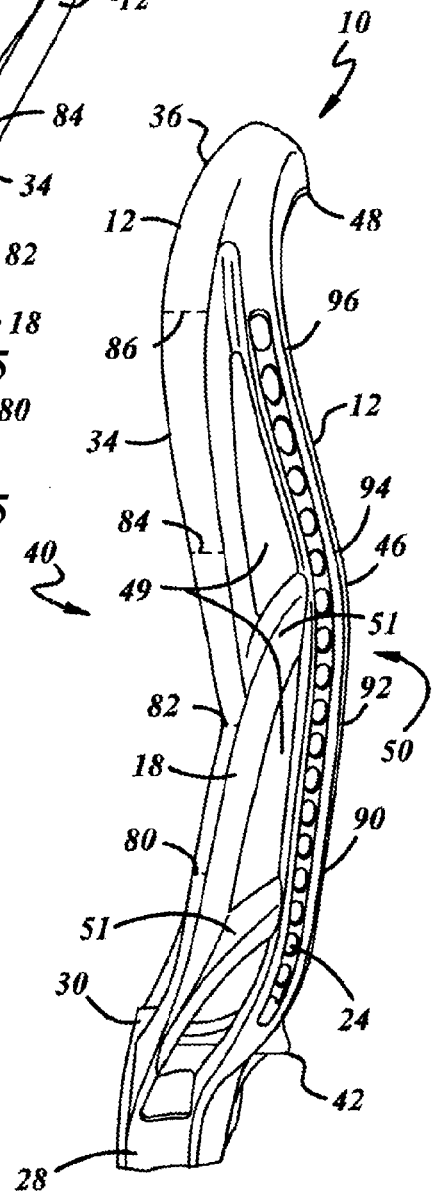
FIG. 2 is a right side view of the lacrosse head.

As shown in FIG. 2, the sidewalls can be of an open frame construction, wherein those sidewalls define one or more non-string apertures 49 between the upper and lower rims. These apertures can be of any pre-selected shape, and can be configured for structural or aesthetic purposes as desired. In addition to the non-string holes, the sidewalls and other portions of the head can include multiple net securing structures that allow attachment of netting (not shown) to the head 10. As shown, these structures are in the form of holes 24 defined by the various components of the head. The precise placement of these string holes can vary as desired.

The sidewalls 16 and 18 can be positioned on opposite sides of a longitudinal axis 100 of the head, which can generally bisect the head in opposing halves. The longitudinal axis 100 can pass directly through the middle of the ball stop 23 as described in further detail below. One or both of the sidewalls 16, 18 can extend generally from the ball stop 23 toward the scoop 20, which is located at the opposite end of the head 10.

Figure 4:
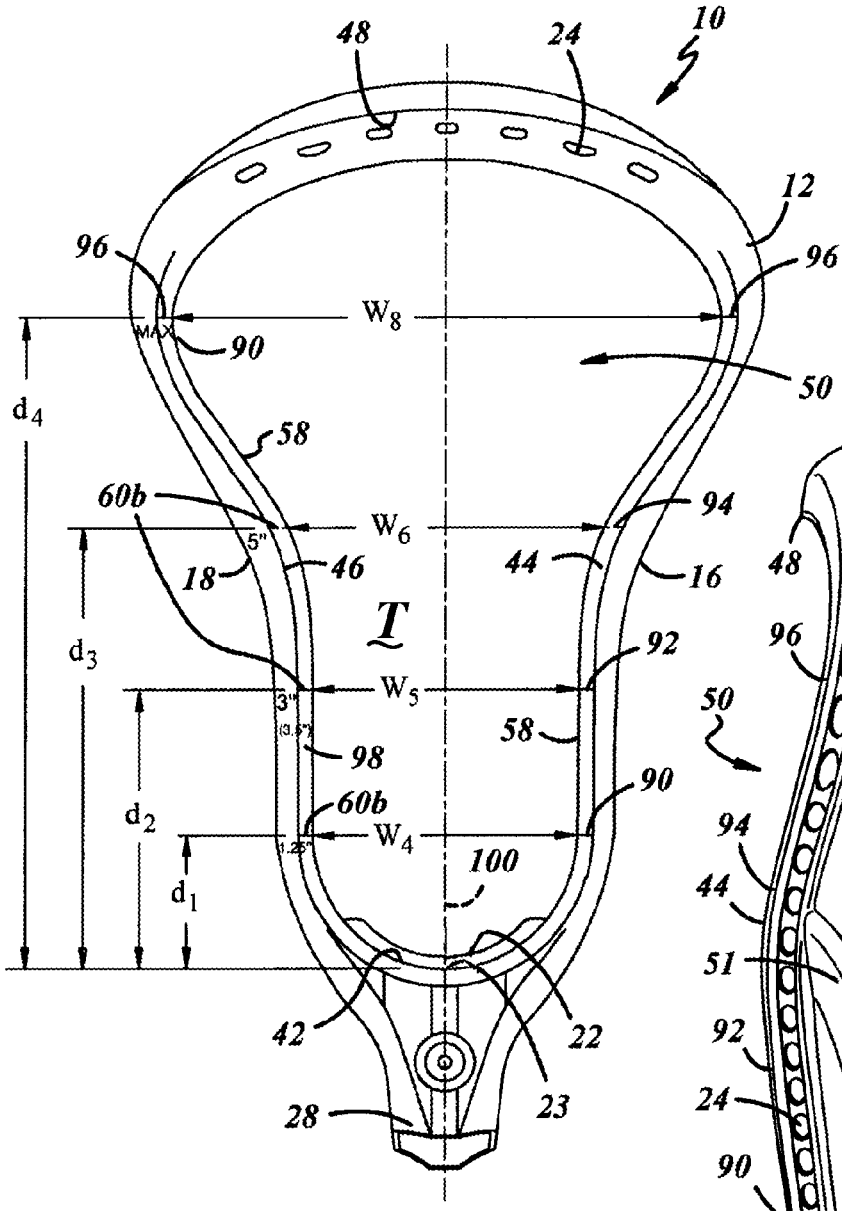
FIG. 4 is rear view of the lacrosse head.
Figure 3:
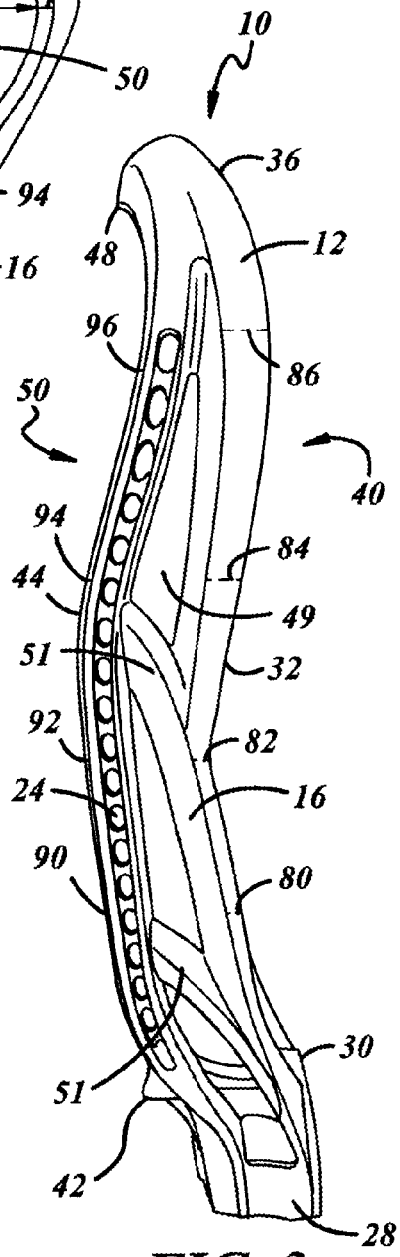
FIG. 3 is a left side view of the lacrosse head.

Referring to FIGS. 1 and 4, the lacrosse head can be outfitted with a ball stop cushion 22, which is positioned in the ball stop 23. This cushion can include first and second ends distal from one another, and can be of a uniform thickness from the first end to the second end. The cushion can be constructed from foam, or other resilient materials, and can include a cover (not shown). The cushion 22 can be joined with the ball stop 23 with any suitable fastener, such as adhesives, strings, laces, rivets and the like.

The lacrosse head 10 optionally can include a socket 28 extending generally rearward from the base 14 of the frame element 12 for attachment of a stick handle (not shown) or element thereto. The socket 28 can be tubular in shape and can define a cavity to receive a handle. Alternatively, the base 14 can include a projection (not shown) which is adapted to fit within a handle. The handle can be secured within the socket 28, optionally by a fastener (not shown), such as a screw, peg, or other fastening devices or materials such as adhesives. Further, while the head 10 and the handle are discussed as separate components, they can be permanently attached to one another or can be formed as a single unitary structure.

As shown in FIG. 1, the upper rim 30 of the base 14 and the upper rims 32, 34 of the sidewalls 16, 18 respectively together, in connection with the upper rim 36 of the scoop 20, define a ball receiving area 40. This ball receiving area 40 can be where a lacrosse ball can enter or exit the head 10 when the ball is caught, thrown, shot or dislodged.

As illustrated in FIG. 4 the lower rim 42 of the base 14 and the lower rims 44, 46 of the sidewalls 16, 18 respectively together, in connection with the lower rim 48 of the scoop 20, define a ball retaining area 50. This ball retaining area 50 can be where a lacrosse ball typically is located when retained in the head 10 and more particularly in the netting 26 attached to the head 10.

Returning to FIGS. 2-3, the upper rims 32, 34 can define the uppermost surfaces of the sidewalls 16, 18, while the lower rims 44, 46 can define the lowermost surfaces of the sidewalls 16, 18. The upper rims 32, 34 and lower rims 44, 46 can be part of respective solid, unitary sidewalls, or can be separate rails separated by non string apertures 49 and including supports 51 as shown, or of any other structure as desired.

In plan view, the upper rims 32, 34 also can follow an outward curvilinear path near the base 14 before extending parallel to the central longitudinal axis 100 along a portion of its length, generally within the throat region T of the head. The throat region T can generally extend from the ball stop 23 to ½ to ⅔ the length of the ball receiving area 40 of the head, or any other distance therebetween. Optionally, the upper and lower rims can be of a circular, polygonal, elliptical, rectangular, or beveled cross-sections that are generally uniform or vary as these elements extend from the base to the scoop.

The head 10 can be of an open frame, monolithic construction, with its various components formed from one or more of a variety of compounds such as nylon, urethane, polycarbonate, polyethylene, polypropylene, polyketone or polybutylene terephalate.

As illustrated in FIGS. 1 and 4, the lacrosse head 10 provides indicia, visible to the human eye, generally in the form of markings. As used herein, indicia can also be referred to as compliance elements, or more generally, elements. As described below, the compliance elements can be in the form of visible line elements, other visible geometric features, protrusions, projections, recesses, depressions, other structures or markings, and/or combinations of the foregoing. A first or front set of indicia 60*a* can be located on the upper rims 32, 34 of each of the sidewalls 16, 18 and a second, or rear set of indicia 60*b* located on the lower rims 44, 46 of each of the sidewalls 16, 18.

More particularly, the front indicia 60*a* can include individual paired indicia 80, 82, 84 located on the upper rims 32, 34 at a predetermined distance d1, d2, and d3 from the middle of the ball stop 23. Similarly, the rear indicia 60*b* can include individual paired indicia 90, 92, 94 located on the lower rims 44, 46 at a predetermined distance d1, d2, and d3 from the middle of the ball stop 23. These sets of indicia 60*a*, 60*b* can provide a precise location on each of the sidewalls 16, 18 for measuring widths W1, W2, and W3 between the upper rims 32, 34 and for measuring widths W4, W5, and W6 between the lower rims 44, 46 of the head 10 that corresponds to these predetermined distances d1, d2, and d3. The widths W1, W2, and W3 are measured between the innermost surfaces 56 of the respective upper rims 32, 34, while the widths W4, W5, and W6 are measured between the innermost surface 58 of the respective lower rims 44, 46.

In compliance with the Proposed Rules, and in particular NCAA Rule 1.17, scheduled to be implemented Jan. 1, 2010, the distances d1, d2, and d3 can be located at 1.25 inches, 3.0 inches, and 5.0 inches, respectively, from the inner surface of the ball stop 23 as measured along a longitudinal axis 100, which bisects the handle, base 14 and scoop 20, and which equidistant from each of the respective sidewalls 16, 18. The widths W1, W2, and W3 can be perpendicular to this longitudinal axis 100 and can provide an indication as to whether the lacrosse head complies with the minimum dimensional measurements associated with the distances d1, d2, and d3 along the ball receiving portion 40 as directed by the Proposed Rules. Similarly, the widths W4, W5, and W6 can be perpendicular to the longitudinal axis 100 and can provide an indication as to whether the lacrosse head complies with the minimum dimensional measurements associated with the distances d1, d2, and d3 along the ball retaining portion 50 as directed by the Proposed Rules.

Optionally, indicia 86 can be located at a position corresponding to the widest portion W7 between the upper rims 32, 34. Other indicia 96 can be located at a position corresponding to the widest portion W8 between the lower rims 44, 46. These indicia 86, 96 can be located equidistant from the inner surface of the ball stop 23, although in some embodiments the indicia 86, 96 may not be equidistant. The widths W7 and W8 are therefore measured perpendicular to the longitudinal axis 100 between the respective innermost surfaces 56, 58 of the sidewalls 16, 18 along these indicia 86 or 96 and provide an indication as to minimum or maximum width of the lacrosse head between the sidewalls 16, 18 on either the ball receiving side 40 or ball retaining side 50, as provided by the Proposed Rules, for example, a minimum distance of 6.5 inches on the front between the narrowest points of the head, and a minimum distance of 6.0 inches on the back between the narrowest points of the head.

These individual indicia 80, 82, 84, 86, 90, 92, 94, and 96 may take on many forms. For example, as shown in FIGS. 1-4, the indicia 80, 82, 84, 86, 90, 92, 94, and 96 can be visible lines located along the respective visible surface of the sidewalls 16, 18. The indicia 80, 82, 84, 86, 90, 92, 94, and 96 can additionally or alternatively include alphanumeric symbols, such as text, letters or numerals. For example, as shown in FIG. 1, "1.25 inches" may be placed on the upper rim 32 at a distance 1.25 inches from the inner surface of the base 14, corresponding to the indicia 80. Likewise, the alphanumeric symbols "MAX" or "max" can be placed on the upper rim 32, 34 of each of the sidewalls 16, 18 at a position corresponding to widest distance W7 provided by the Proposed Rules between the respective sidewalls 16, 18 corresponding to indicia 86.

Optionally, the indicia 80, 82, 84, 86, 90, 92, 94, and 96 can include both the visible line and afore mentioned alphanumeric symbol marks. In this way, the lacrosse head can be measured between an associated indicia 80, 82, 84, 86, 90, 92, 94, and 96 to determine compliance with the new dimensional widths of the Proposed Rules.

As shown in FIGS. 1 and 4, optional, additional indicia 88, 98 can be provided. The additional indicia 88 can provide an actual measured width at one or more of the indicia 80, 82, 84, 86 between the upper rims 32, 34, while the indicia 98 provides the actual width measurement at one or more of the indicia 90, 92, 94, and 96 along the between the lower rims 44, 46. These additional indicia 88, 98 can be in the form of a alphanumeric marking in inches. With this additional marking, a game official inspecting the lacrosse head 10 can visually confirm that the head 10 is in compliance with the Proposed Rules, or confirm the accuracy of the indicia 88, 98 by taking a measurement across the head between the inner surfaces of the sidewalls, aligning the measurement device with the indicia 84 or 92, respectively.

For example, as shown in FIG. 1, the upper rims 32, 34 can include additional indicia 88 (here, 4") under the reference indicia 86 (which is a line and the text 5"). This additional indicia 88 indicates that the width W3 of the head 10 between the inner surfaces 56 of the upper rims 32, 34, at a distance d3 from the ball stop 23 along the longitudinal axis, is 4 inches wide. This width of 4 inches is compliant with the Proposed Rules providing that the width be a minimum of 4 inches at this location. Similarly, the lower rims 44, 46 shown in FIG. 4 can include additional indicia 98 marked with the actual width (here, 3.5") adjacent the indicia 92 to indicate that the width W5 of the head 10 between the inner surfaces 58 of the lower rims 44, 46 at a distance d2 from the ball stop 23 along the longitudinal axis, is 3.5 inches wide. This width of 3.5 inches is compliant with the Proposed Rules providing that the width be a minimum of 3 inches at this location.

These respective sets of indicia 60*a*, 80, 82, 84, 86, 88, 90, 92, 94, 96 and 98 can be included on the lacrosse head 10 during the forming process. For example, the plastic material forming a plastic lacrosse head 10 may be colored with dyes, inks, paints, coatings or differently colored plastics at predetermined locations corresponding to the respective indicia 80, 82, 84, 86, 88, 90, 92, 94, 96 and 98. This material can then be injection molded with non-colored or alternatively colored material forming the remainder of the frame 12. Optionally, the mold in which the head 10 is molded can be modified at predetermined locations corresponding to the indicia 80, 82, 84, 86, 88, 90, 92, 94, 96 and 98 to provide a raised or recessed structure that is visible to the human eye.

Figure 5A:
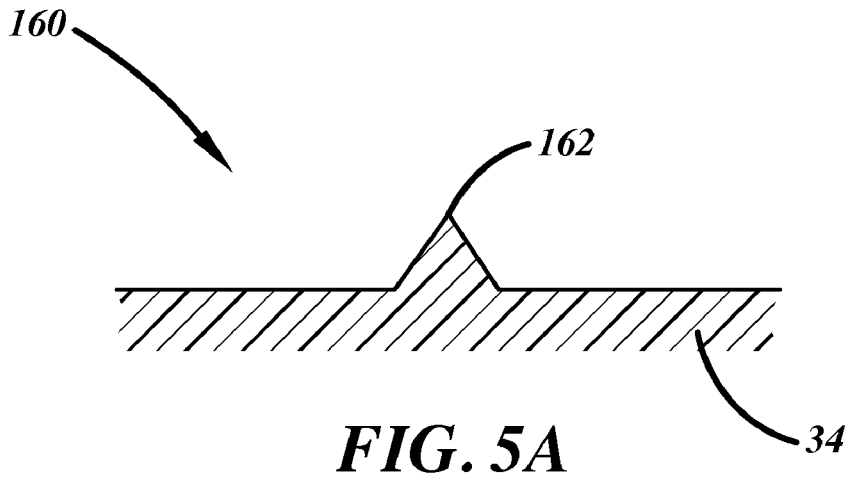
FIG. 5A is a section view of an indicia take along line 5-5 in FIG. 1.

As shown in FIG. 5A, the indicia 160 can be in the form of a protrusion 161 that extends upwardly from the upper rims 32, 34 and that is clearly discernable and visible to a viewer. The protrusion can be of a generally linear configuration that extends across all or a portion of each of the upper rims 32, 34 to provide an accurate measurement indicia, or alternatively, the protrusion can be a small, independent, isolated protrusion. The indicia 160 whether linear or point like, can terminate at a point 162, which can correspond to the precise location where a measurement, for example, W4, is taken. Although shown as a triangular shaped protrusion, the indicia 160 can be of varying geometric configurations. The indicia at any desired location of measurement on the upper or lower rims can likewise include this protrusion configuration.

Figure 5B:
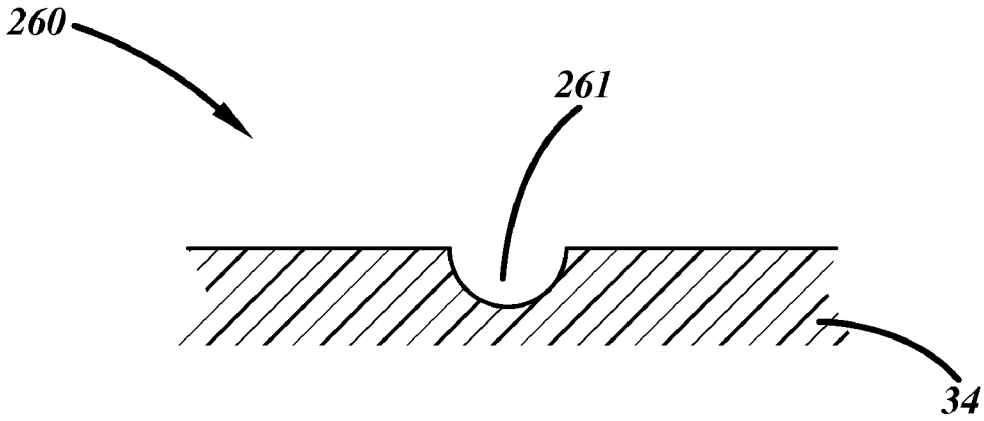
FIG. 5B is a section view of an indicia take along line 5-5 in FIG. 1.

As illustrated in FIG. 5B, the indicia 260 can be in the form of a recess 261 defined by the upper rim 34 and that is clearly discernable and visible to a viewer. The recess 261 can be of a generally linear configuration that extends across all or a portion of each of the upper rims 32, 34 to provide an accurate measurement indicia, or optionally, the recess can be a small, independent, divot-like hole, aperture or recess. The indicia 260 can correspond to the precise location where a measurement, such as, for example, W4 is taken. Although shown as a rounded, semi-circular trough, the indicia 260 can be of varying geometric configurations, for example, the recess can be rectangular shaped, triangular shaped, or otherwise configured. The indicia at any desired location of measurement on the upper or lower rims can likewise include this recessed indicia configuration.

Figure 5C:
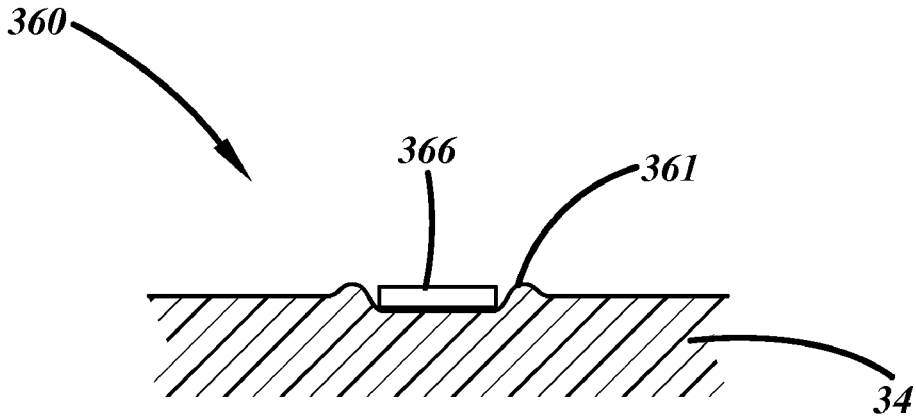
FIG. 5C is a section view of an indicia take along line 5-5 in FIG. 1.

Further optionally, as shown in FIG. 5C, the indicia 360 can be in the form of a recess 361 having a predetermined width and depth to capture an associated measuring device, such as a measuring tape 366 of a given dimension, e.g., a tape being ⅛ inch, ¼ inch, ½ inch, ¾ inch or 1 inch in width. With this construction, an official can place their measuring tape 366 within the recess 361, and measure the corresponding width at that location.

To manufacture a head 10 including the recess and/or protrusion indicia above, a mold is provided. The mold defines a lacrosse head cavity including mold surfaces corresponding to the base 14, the pair of opposing sidewalls 16, 18, the scoop 20 connecting the pair of opposing sidewalls 16, 18 opposite the base 14, as well as a ball stop 23, as illustrated in FIGS. 1-4. A longitudinal axis is established with reference to the mold surfaces, where that axis corresponds to the longitudinal axis 100 of the head 10.

The mold is then configured so that the upper and/or lower rims at distances d1, d2, d3 and d4 include at least one of the above described protrusion and recess indicia 161, 261, 361, or other comparable indicia, in paired combinations and/or sets. Those pairs or sets of mold indicia, that is, the protrusion and/or recess indicia, are optionally established along lines, and more particularly, within planes perpendicular to the longitudinal axis 100 and located at 1.25 inches, 3.0 inches, and 5.0 inches from the mold surface corresponding to the ball stop, that is, the "throat" of the "crosse" as identified in the Proposed Rules, or other dimensions corresponding to the Proposed Rules. With the mold indicia established in the mold, material is introduced into the mold to form the respective head components to mold a lacrosse head. The mold indicia creates multiple sets of measurement indicia located on one or both of the pair of sidewalls 16, 18 of the head. That measurement indicia can be in the form of protrusions and/or recesses as described above. For example, the protrusions and/or recesses can be linear structures that extend across the respective sidewalls to establish a reference measurement line that is ready to assist in measurement of head dimensions.

Optionally, certain alphanumeric symbols can be associated with the mold indicia and/or measurement indicia. These alphanumeric symbols can be painted or inked on or in the sidewalls, or formed as symbols that protrude from, or that are recessed in, the sidewalls.

Alternatively, the indicia 60*a*, 80, 82, 84, 86, 88, 90, 92, 94, 96 and 98 can be applied to the sidewalls 16, 18 after the head 10 is fully molded or otherwise constructed. For example, the indicia 60*a*, 60*b*, 80, 82, 84, 86, 88, 90, 92, 94, 96 and 98 can be painted onto the sidewalls 16, 18. Optionally, the indicia 60*a*, 60*b*, 80, 82, 84, 86, 88, 90, 92, 94, 96 and 98 can be in the form of stickers that are applied to the lacrosse head in a post-production step. In yet another embodiment, a placard or card could be coupled to the head, or provided with the packaging associated with the head, to provide this information.

In use, an official or other individual desiring to measure a lacrosse head to determine compliance with the Proposed Rules will place a measuring device, such as a measuring tape, across the head 10. The tape is aligned with the indicia to establish the precise location at which a measurement is to be taken. For example, when measuring width W1 as shown in FIG. 1, an official places a measurement tape or instrument across or within the head 10 so that the tape or instrument is precisely aligned with paired indicia 80. The official then reads the measurement, and compares it with the minimum measurement of 3.0 inches when the sidewalls are measured at a distance of 1.25 inches from the ball stop as provided by the Proposed Rules. If the measurement is equal to or greater than 3.0 inches, then the official can confirm that this measurement complies with the Proposed Rules. If not, the official can confirm that this measurement does not comply with the Proposed Rules, and therefore that the head is illegal.

By including sets indicia 80, 82, 84, 86, 88, 90, 92, 94, 96 and 98 on the visible surfaces of the lacrosse head 10, the present invention provides valuable information regarding the precise location for measuring the head 10 to ensure compliance with any dimensional measurements.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A lacrosse head comprising:

a frame including a ball stop, a scoop, and a pair of sidewalls joined with the scoop and ball stop, the pair of sidewalls cooperatively defining a throat region near the ball stop, each of the pair of sidewalls defining an inner surface, each of the pair of sidewalls including an upper rim that faces upward on the frame, each upper rim including an uppermost surface;

a longitudinal axis extending from the ball stop to the scoop, the longitudinal axis being equidistant from the inner surfaces of each of the pair of sidewalls;

a primary visible, readily discernible compliance element located on each of the sidewalls at a first predetermined distance that is 1.25 inches from the ball stop in the throat region, the primary compliance elements providing a first reference along each of the pair of sidewall regions for measuring a first width between the inner surfaces of the pair of sidewalls to determine whether the first width is in compliance with a first minimum width measurement for the lacrosse head at the first predetermined distance, the first width measured between the primary compliance elements along a first measurement line that is perpendicular to the longitudinal axis; and a secondary visible, readily discernible compliance element located on each of the sidewalls at a second predetermined distance that is 3.0 inches from the ball stop in the throat region, the secondary compliance elements providing a second reference along each of the pair of sidewall regions for measuring a second width between the inner surfaces of the pair of sidewalls to determine whether the second width is in compliance with a second minimum width measurement for the lacrosse head at the second predetermined distance, the second width measured between the secondary compliance elements along a second measurement line that is perpendicular to the longitudinal axis;

wherein the primary compliance elements are located on the uppermost surfaces of the upper rims of each of the pair of sidewalls;

wherein the primary compliance elements are at least one of a visible protrusion extending upwardly from the uppermost surface of the upper rim and a visible recess defined by the uppermost surface of the upper rim;

wherein the at least one of the visible protrusion and the visible recess includes a point that lies along the first measurement line;

wherein the at least one of the visible protrusion and visible recess is located distal from the scoop and is located distal from the ball stop, wherein the primary compliance elements include a first compliance element on the uppermost surface of the upper rim of a first sidewall of the pair of sidewalls, and a second compliance element on the uppermost surface of the upper rim of a second sidewall of the pair of sidewalls, wherein the first compliance element and the second compliance element are symmetrically disposed on opposite sides of the longitudinal axis so that a measurer of the lacrosse head can align a measuring device with the first compliance element and second compliance element, with the resulting position of the measuring device being at the first predetermined distance, and the measuring device being disposed at least partially along and parallel to the first measurement line, wherein the secondary compliance elements are located on the uppermost surfaces of the upper rims of each of the pair of sidewalls;

wherein the secondary compliance elements are at least one of a visible protrusion extending upwardly from the uppermost surface of the upper rim and a visible recess defined by the uppermost surface of the upper rim;

wherein the secondary compliance elements include a point that lies along the second measurement line;

wherein the secondary compliance elements are located distal from the scoop and located distal from the ball stop, wherein the secondary compliance elements include a third compliance element on the uppermost surface of the upper rim of the first sidewall of the pair of sidewalls, and a fourth compliance element on the uppermost surface of the upper rim of the second sidewall of the pair of sidewalls, wherein the third compliance element and the fourth compliance element are symmetrically disposed on opposite sides of the longitudinal axis so that the measurer of the lacrosse head can align the measuring device with the third compliance element and fourth compliance element, with the resulting position of the measuring device being at the second predetermined distance, and the measuring device being disposed at least partially along and parallel to the second measurement line.

2. The lacrosse head of claim 1 wherein each of the primary compliance elements is a visible recess defined by the upper rim, the visible recess being generally linear and extending across the upper rim.

3. The lacrosse head of claim 2, wherein the visible recess is of a predetermined recess width adapted to receive a portion of a measuring tape therein, whereby the measurer can insert the portion of the measuring tape in the visible recess.

4. A lacrosse head comprising:

a ball stop;

a scoop distal from the ball stop;

a pair of sidewalls extending from the ball stop and joined with one another distal from the ball stop at the scoop, each sidewall being of an open frame construction and defining at least one string hole and at least one non-string hole, the pair of sidewalls cooperatively defining a throat region near the ball stop, each of the pair of sidewalls defining an inner surface, each of the sidewalls including an upper rim on a front of the lacrosse head and a lower rim on the rear of the lacrosse head, the pair of sidewalls including a first sidewall and an opposing second sidewall;

a longitudinal axis extending longitudinally from the ball stop toward the scoop, generally bisecting the lacrosse head;

a first visible, readily discernible compliance element located on the first sidewall at a first predetermined distance that is 1.25 inches from the ball stop in the throat region, the first compliance element providing a first reference along the first sidewall;

a second visible, readily discernible compliance element located on the opposing second sidewall at the first predetermined distance that is 1.25 inches from the ball stop in the throat region, the second compliance element providing a second reference along the second sidewall, wherein the first compliance element and the second compliance element are symmetrically disposed on opposite sides of the longitudinal axis, wherein the first compliance element and the second compliance element both lay along a common first measurement line that is perpendicular to the longitudinal axis, the first measurement line corresponding to a first width between the inner surfaces of the pair of sidewalls to determine whether the first width is a minimum of 3 inches at the first predetermined distance, the first width measured between the first compliance element and the second compliance element along the first measurement line that is perpendicular to the longitudinal axis;

a third visible, readily discernible compliance element located on the first sidewall at a second predetermined distance that is 3.0 inches from the ball stop in the throat region, the third compliance element providing a third reference along the first sidewall;

a fourth visible, readily discernible compliance element located on the opposing second sidewall at a second predetermined distance that is 3.0 inches from the ball stop in the throat region, the fourth compliance element providing a fourth reference along the second sidewall, wherein the third compliance element and the fourth compliance element are symmetrically disposed on opposite sides of the longitudinal axis, wherein the third compliance element and the fourth compliance element both lay along a common second measurement line that is perpendicular to the longitudinal axis, the second measurement line corresponding to a second width between the inner surfaces of the pair of sidewalls to determine whether the second width is a minimum of 3 inches at the second predetermined distance, the second width measured between the third compliance element and the fourth compliance element along the second measurement line that is perpendicular to the longitudinal axis; and wherein each of the first, second, third and fourth compliance elements are distal from the ball stop and distal from the scoop, wherein the second visible, readily discernable compliance elements are located between the scoop and the first visible, readily discernable compliance element, whereby a measurer of the lacrosse head can place a measuring device perpendicular to the longitudinal axis, parallel with the first and second compliance elements, and the third and fourth compliance elements, to determine whether the first width and the second width, respectively, are in compliance with a minimum width measurement for the lacrosse head at the respective first and second predetermined distances.

5. The lacrosse head of claim 4 wherein the first and second compliance elements are located on the lower rims of the sidewalls.

6. The lacrosse head of claim 4 wherein the first and second compliance elements are located on the upper rims of the sidewalls and on the lower rims of the sidewalls.

7. The lacrosse head of claim 4 wherein the first and second compliance elements include at least one of a protrusion and a recess defined by the sidewalls.

8. The lacrosse head of claim 7 wherein the first and second compliance elements each include a pair of visible protrusions extending upwardly from the upper rims of the pair of sidewalls on opposite sides of the longitudinal axis, each visible protrusion being generally linear and extending across the respective rim.

9. The lacrosse head of claim 7 wherein the first and second compliance elements each include a pair of visible recesses defined by the upper rims of the pair of sidewalls on opposite sides of the longitudinal axis, each visible recess being generally linear and extending across the respective upper rim.

10. A lacrosse head comprising:

a ball stop;

a scoop distal from the ball stop;

a pair of sidewalls extending from the ball stop and joined with one another distal from the ball stop at the scoop, each sidewall being of an open frame construction and defining at least one string hole and at least one non-string hole, the pair of sidewalls cooperatively defining a throat region near the ball stop, each of the pair of sidewalls defining an inner surface, each of the sidewalls including an upper rim on a front of the lacrosse head and a lower rim on the rear of the lacrosse head;

a longitudinal axis extending longitudinally from the ball stop toward the scoop, generally bisecting the lacrosse head;

a first visible, readily discernible compliance element located on each of the sidewalls at a first predetermined distance that is 1.25 inches from the ball stop in the throat region, the first compliance element providing a reference along each of the pair of sidewalls for measuring a first width between the inner surfaces of the pair of sidewalls to determine whether the first width is a minimum of 3 inches at the first predetermined distance, the first width measured between the first compliance element along a first line that is perpendicular to the longitudinal axis;

a second visible, readily discernible compliance element located on each of the sidewalls at a second predetermined distance that is 3.0 inches from the ball stop in the throat region, the second compliance element providing a reference along each of the pair of sidewalls for measuring a second width between the inner surfaces of the pair of sidewalls to determine whether the second width is a minimum of 3 inches at the second predetermined distance, the second width measured between the second compliance element along a second line that is perpendicular to the longitudinal axis;

a third visible, readily discernible compliance element located on each of the sidewalls at a third predetermined distance that is 5.0 inches from the ball stop in the throat region, the third compliance element providing a reference along each of the pair of sidewalls for measuring a third width between the upper rims of the pair of sidewalls to determine whether the third width is a minimum of 4 inches at the third predetermined distance, the third width measured between the third compliance element along a third line that is perpendicular to the longitudinal axis; and a fourth visible, readily discernible compliance element located on each of the sidewalls at a position of maximum width between the upper rims of the pair of sidewalls, the fourth compliance element providing a reference along each of the pair of sidewalls for measuring a fourth width between the upper rims of the pair of sidewalls to determine whether the fourth width is a minimum of 6.5 inches at the position of maximum width between the upper rims, the fourth width measured between the fourth compliance element along a fourth line that is perpendicular to the longitudinal axis, wherein each of the first, second, third and fourth visible, readily discernible compliance elements each include matched pairs of first and second elongated line elements that are located on the opposing upper rims of the respective sidewalls, wherein each of the first, second, third and fourth visible, readily discernible compliance elements are distal from the ball stop and the scoop, wherein the first and second elongated line elements are symmetrically disposed on opposite sides of the longitudinal axis on the respective sidewalls, wherein the first and second elongated line elements are aligned and parallel with one another across the longitudinal axis, whereby a measurer of the lacrosse head can place a measuring device adjacent the first, second, third and fourth compliance elements to determine whether the first, second, third and fourth widths are in compliance with a minimum width measurement for the lacrosse head.

11. The lacrosse head of claim 10 wherein each of the first and second line elements include a generally linear protrusion that extends across at least a portion of the upper rim.

12. The lacrosse head of claim 10 wherein each of the first and second line elements include a generally linear recess that extends across at least a portion of the upper rim.

13. The lacrosse head of claim 10 wherein the first, second, third and fourth visible, readily discernable compliance elements include alphanumeric symbols.

14. The lacrosse head of claim 13 wherein the first, second and third visible, readily discernable compliance elements include the respective predetermined distance from the ball stop measured at each compliance element.

15. The lacrosse head of claim 14 wherein the first, second, third and fourth visible, readily discernable compliance elements each include the corresponding first, second, third and fourth widths.

16. The lacrosse head of claim 15 wherein the fourth compliance element includes an alphanumeric symbol that fourth indicates the compliance element is positioned at the maximum width between the upper rims of the pair of sidewalls.

17. The lacrosse head of claim 16 wherein the fourth compliance element includes at least one of the alphanumeric symbols "max" or "MAX."

18. The lacrosse head of claim 10 wherein the first, second and third visible, readily discernable compliance elements are located on the upper rims and on the lower rims of the pair of sidewalls, with the first, second and third visible, readily discernable compliance elements are each aligned and parallel from the top to the bottom rims, wherein the third compliance element provides a reference along each of the pair of sidewalls for measuring a fifth width between the lower rims of the pair of sidewalls to determine whether the fifth width is a minimum of 3.5 inches at the third predetermined distance, the fifth width measured between the third compliance element along a fifth line that is perpendicular to the longitudinal axis, wherein a fifth visible, readily discernible compliance element is located on each of the sidewalls at a position of maximum width between the lower rims of the pair of sidewalls, the fifth compliance element providing a reference along each of the pair of sidewalls for measuring a sixth width between the lower rims of the pair of sidewalls to determine whether the sixth width is a minimum of 6 inches at the position of maximum width between the lower rims, the sixth width measured between the fifth compliance element along a sixth line that is perpendicular to the longitudinal axis.

* * * * *